US007762100B2

(12) United States Patent
Bae et al.

(10) Patent No.: US 7,762,100 B2
(45) Date of Patent: Jul. 27, 2010

(54) REFRIGERATOR

(75) Inventors: Jun-Ho Bae, Seoul (KR); Soo-Kwan Lee, Seoul (KR); Chang-Joon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 253 days.

(21) Appl. No.: 11/619,417

(22) Filed: Jan. 3, 2007

(65) Prior Publication Data

US 2007/0266728 A1 Nov. 22, 2007

(30) Foreign Application Priority Data

May 19, 2006 (KR) ..... 10-2006-0045311

(51) Int. Cl.
*F25D 17/06* (2006.01)
*F25D 17/04* (2006.01)

(52) U.S. Cl. ..... 62/419; 62/413; 62/416

(58) Field of Classification Search ..... 62/415, 62/419, 255, 414; 137/808
See application file for complete search history.

(56) References Cited

U.S. PATENT DOCUMENTS

| | | | | |
|---|---|---|---|---|
| 3,050,961 | A * | 8/1962 | Mann et al. | 62/419 |
| 3,695,775 | A * | 10/1972 | Zenkner | 415/53.1 |
| 3,763,660 | A * | 10/1973 | Burney | 62/280 |
| 5,299,763 | A * | 4/1994 | Bescoby et al. | 244/118.5 |
| 6,041,616 | A * | 3/2000 | Jeong | 62/419 |
| 6,086,324 | A * | 7/2000 | Ikeda et al. | 415/53.1 |
| 6,223,539 | B1 * | 5/2001 | Bell | 62/3.7 |
| 6,622,504 | B2 | 9/2003 | Lee et al. | |
| 6,694,761 | B2 | 2/2004 | Cho et al. | |
| 6,848,264 | B2 | 2/2005 | Sung et al. | |
| 6,948,908 | B2 | 9/2005 | Jung et al. | |
| 6,997,682 | B2 | 2/2006 | Jung et al. | |
| 2005/0217307 | A1 | 10/2005 | Kim et al. | |

FOREIGN PATENT DOCUMENTS

| | | |
|---|---|---|
| JP | 58-8971 | 1/1983 |
| JP | 2001-90975 | 4/2001 |
| JP | 2002-147921 | 5/2002 |
| WO | WO 2004113806 A1 * | 12/2004 |

OTHER PUBLICATIONS

U.S. Appl. No. 11/619,461 to Lee et al., filed Jan. 3, 2007.
Japanese Office Action.
Japanese Office Action dated Aug. 11, 2009.

* cited by examiner

*Primary Examiner*—Frantz F. Jules
*Assistant Examiner*—Cassey Bauer
(74) *Attorney, Agent, or Firm*—Ked & Associates LLP

(57) ABSTRACT

A refrigerator is provided that includes a fan that blows cool air generated by an evaporator to a freezing chamber or a refrigerating chamber; a scroll guide that discharges cool air discharged from the fan in two directions; a guide pipeline formed at the scroll guide in two directions, that guides cool air discharged from the scroll guide; and a cool air duct connected to the guide pipeline, that supplies cool air to the freezing chamber or the refrigerating chamber. An optimum scroll guide that can be applicable even when a plurality of cool air ducts are implemented is provided, thereby reducing a flow loss of cool air discharged from the fan and decreasing power consumption.

9 Claims, 5 Drawing Sheets

REFRIGERATOR

RELATED APPLICATION

The present disclosure relates to subject matter contained in priority Korean Application No. 10-2006-0045311, filed on May 19, 2006, which is herein expressly incorporated by reference in its entirety.

BACKGROUND OF THE INVENTION

1. Field of the Invention

The present invention relates to a refrigerator, and more particularly, to a refrigerator having a scroll guide capable of enhancing efficiency of a fan of a refrigerator using a plurality of cool air ducts.

2. Description of the Background Art

Generally, a refrigerator is provided with an inner space including a refrigerating chamber and a freezing chamber partitioned by an partition wall. The freezing chamber is maintained at a low temperature so as to keep stored goods such as food in the frozen state. Also, the refrigerating chamber keeps food freshly, but the food is not maintained in the frozen state.

Hereinafter, the conventional refrigerator will be explained with reference to FIG. 1.

FIG. 1 is a sectional view showing an inner construction of a cool air passage of a refrigerator in accordance with the conventional art.

As shown, a cool air inlet 24 for introducing increased temperature cool air having performed a cooling operation by circulating the freezing chamber 20 and the refrigerating chamber 30 is provided at a lower portion of the freezing chamber 20.

An evaporator 23 for heat-exchanging the increased temperature cool air thereby generating lowered temperature cool air is disposed above the cool air inlet 24. A fan 22 for blowing the lowered temperature cool air is disposed above the evaporator 23.

The evaporator 23 and the fan 22 are installed only at the freezing chamber 20.

The fan 22 is driven by a motor (not shown), and is installed in a scroll guide (not shown) thus to blow cool air to a cool air duct 21.

One guide pipeline (not shown) for guiding cool air to the cool air duct 21 is formed at the scroll guide. Since one cool air duct 21 for flowing cool air in one direction is installed at the freezing chamber 20, one guide pipeline for guiding cool air to an inlet of the cool air duct 21 is formed at the scroll guide.

The cool air duct 21 for supplying lowered temperature cool air to the freezing chamber 20 is formed above the fan 22. A plurality of cool air outlets 21 a for discharging cool air into the freezing chamber 20 are formed at the cool air duct 21. The cool air duct 21 is installed at a rear wall (not shown) of the freezing chamber 20 as the singular number One cool air duct 31 is installed at a rear wall (not shown) of the refrigerating chamber 30 so as to be communicated with the cool air duct 21 of the freezing chamber 20. A plurality of cool air outlets 31*a* for discharging cool air into the refrigerating chamber 30 are formed at the cool air duct 31 of the refrigerating chamber 30.

An operation of the conventional refrigerator 10 will be explained.

When the refrigerator 10 is operated, a compressor (not shown) is operated to cool the evaporator 23. The increased temperature cool air introduced to the cool air inlet 24 provided at a lower portion of the evaporator 23 passes through the evaporator 23, and then is heat-exchanged. The increased temperature cool air is converted into lowered temperature cool air, and then is introduced into the fan 22. Most of the cool air discharged from the fan 22 is supplied to the freezing chamber 20 through the cool air duct 21 and the cool air outlet 21*a*.

Some of the cool air is introduced into the cool air duct 31 through a cool air connection port (not shown), and then is supplied to the refrigerating chamber 30 through the cool air outlet 31*a*.

As the cool air repeatedly flows, the freezing chamber 20 and the refrigerating chamber 30 are cooled.

In order to enhance efficiency of the refrigerator 10 or the fan 22 and to perform an independent cooling operation, the cool air duct is respectively installed at both side walls of the freezing chamber 20 and the refrigerating chamber 30 thereby to supply cool air in two directions. Accordingly, required is a scroll guide having a guide pipeline that can be applicable even when a plurality of cool air ducts are respectively installed at both side walls of the freezing chamber 20 and the refrigerating chamber 30.

Furthermore, in order to implement a maximum cooling efficiency, an optimum design of the guide pipeline of the scroll guide is required. Since a flow loss of cool air becomes different according to a minimum gap between the fan and the scroll guide, an optimum design of the scroll guide is required.

SUMMARY OF THE INVENTION

Therefore, an object of the present invention is to provide a refrigerator capable of minimizing a flow loss of cool air discharged from a fan.

Another object of the present invention is to provide a refrigerator having a scroll guide capable of enhancing efficiency of a fan.

To achieve these and other advantages and in accordance with the purpose of the present invention, as embodied and broadly described herein, there is provided a refrigerator, comprising: a fan for blowing cool air generated by an evaporator to a freezing chamber or a refrigerating chamber; a scroll guide for discharging cool air discharged from the fan in two directions; a plurality of guide pipelines formed at the scroll guide in two directions for guiding cool air discharged from the scroll guide; and a plurality of cool air ducts connected to the guide pipeline for supplying cool air to the freezing chamber or the refrigerating chamber.

Cool air is effectively guided into the plurality of cool air ducts formed at the freezing chamber or the refrigerating chamber, thereby minimizing a flow loss of cool air and enhancing efficiency of the fan.

The guide pipeline includes a first guide pipeline and a second guide pipeline formed in two directions of the scroll guide. The first guide pipeline is extending from a first starting point positioned at one side of a horizontal line passing through a rotation center of the fan with a certain curvature in a direction that the fan is rotated, and is connected to the cool air duct. The second guide pipeline is extending from a second starting point positioned at another side of the horizontal line passing through the rotation center of the fan with a certain curvature in a direction that the fan is rotated, and is connected to the cool air duct.

The first starting point is positioned at about 45° to about 55° from a horizontal line passing through a rotation center of the fan in an opposite direction to the rotating direction of the fan, and the second starting point is positioned at about 15° to about 25° from the horizontal line passing through the rotation center of the fan in an opposite direction to the rotating direction of the fan.

Preferably, a minimum gap between the fan and the scroll guide is within the range of 4%~6% of a diameter of the fan.

According to another aspect of the present invention, the refrigerator comprises: a fan for blowing cool air generated by an evaporator to a freezing chamber or a refrigerating chamber; a scroll guide for discharging cool air discharged from the fan; one or more guide pipelines formed at the scroll guide for guiding cool air discharged from the scroll guide; and a cool air duct connected to the guide pipeline for supplying cool air to the freezing chamber or the refrigerating chamber.

One side of the cool air duct is connected to the guide pipeline, and another side thereof is diverged.

Since a flow loss of cool air is reduced at the scroll guide, efficiency of the fan is enhanced and consumption power of the refrigerator is decreased.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

A refrigerator according to the present invention will be explained with reference to FIGS. 2A to 6.

A scroll guide and a cool air duct of a freezing chamber are equal to those of a refrigerating chamber, and thus only a scroll guide 290 and cool air ducts 270 and 280 of the freezing chamber 200 will be explained for convenience.

Figure 2A:
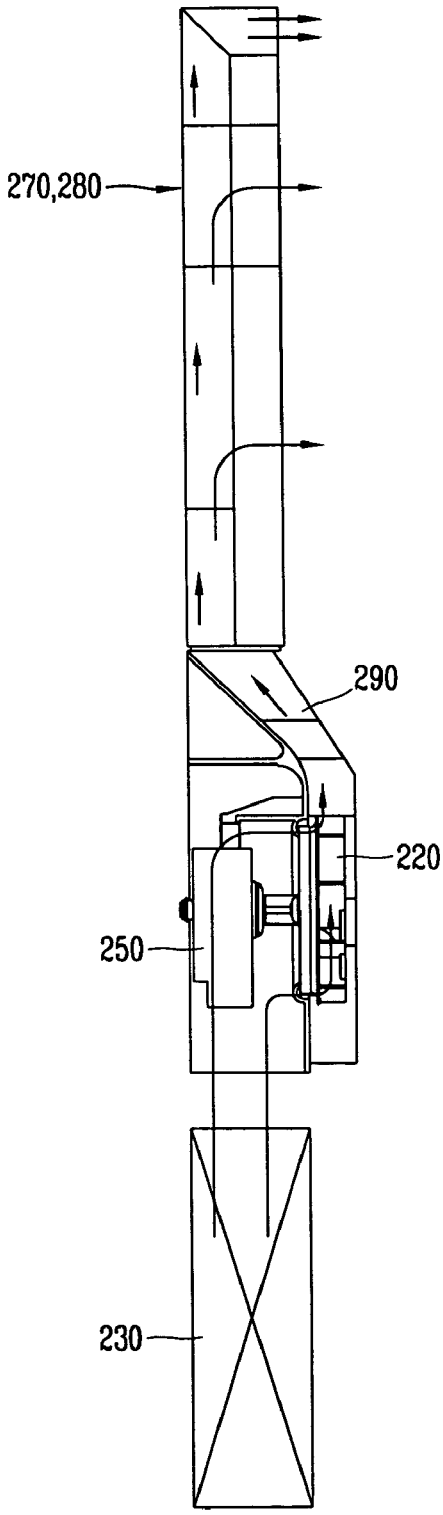
FIG. 2A is a side sectional view showing a cool air channel of a freezing chamber of a refrigerator according to a first embodiment of the present invention.
Figure 2B:
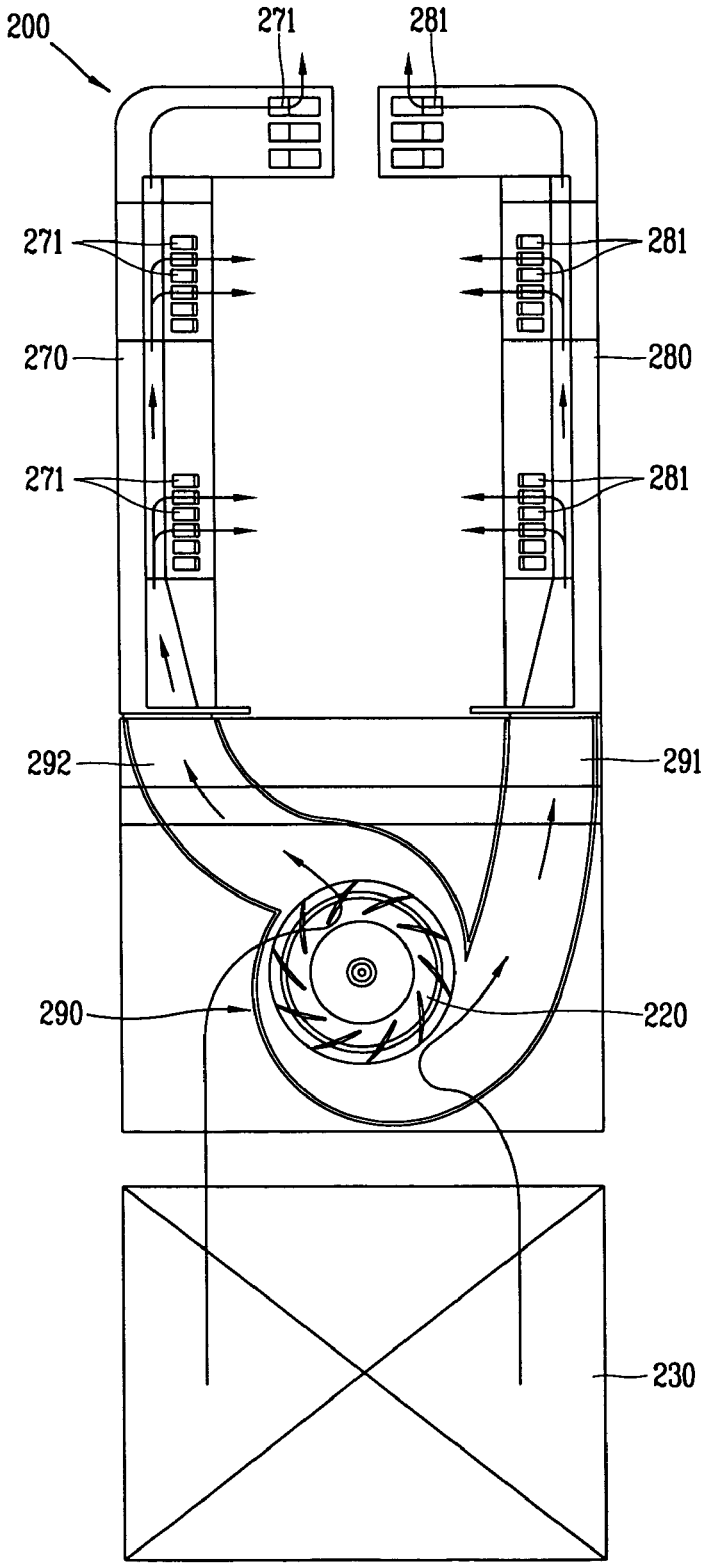
FIG. 2B is a front sectional view showing an inner construction of the cool air channel of the freezing chamber of the refrigerator of FIG. 2A.

As shown in FIGS. 2A and 2B, a refrigerator according to a first embodiment of the present invention comprises an evaporator 230 installed at a freezing chamber 200 separated from a refrigerating chamber by a partition wall 40, for generating cool air; a fan 220 for blowing cool air generated by the evaporator 230; a scroll guide 290 for receiving the fan 220 therein and guiding cool air; a motor 250 for driving the fan 220; and a plurality of cool air ducts 270 and 280 for introducing cool air into the freezing chamber 200.

The fan 220 is installed above the evaporator 230 or at an upper side of a cool air flowing direction, and heat-exchanges increased temperature cool air having performed a cooling operation by circulating the freezing chamber 200 thus to generate lowered temperature cool air. The motor 250 for driving the fan 220 is installed at one side of the fan 220.

The fan 220 is implemented as a centrifugal fan having a plurality of blades, and is installed in the scroll guide 290 for guiding cool air blown by the fan 220 to the cool air ducts 270 and 280.

The scroll guide 290 for receiving the fan 220 therein is connected to the cool air ducts 270 and 280 for supplying cool air to the freezing chamber 200.

The cool air ducts 270 and 280 are implemented in plurality, and preferably, are formed at both sides of the freezing chamber 200 along a side wall of the freezing chamber 200. However, the cool air ducts more than three may be formed.

The cool air ducts 270 and 280 are respectively provided with a plurality of cool air outlets 271 and 281 for evenly supplying cool air into the freezing chamber 200.

Guide pipelines 291 and 292 connected to the cool air ducts 270 and 280 are formed at the scroll guide 290. That is, the guide pipelines 291 and 292 of the scroll guide 290 are formed in two directions of the scroll guide 290 so as to be connected to the cool air ducts 270 and 280 installed along both side walls of the freezing chamber 200. Accordingly, a flow loss of cool air is prevented and consumption power is reduced, thereby enhancing efficiency of the fan.

When the number of the cool air ducts 270 and 280 is more than three, the number of the guide pipelines 291 and 292 connected to the cool air ducts 270 and 280 is also more than three.

A construction of the guide pipelines 291 and 292 of the scroll guide 290 will be explained with reference to FIG. 3.

Figure 3:
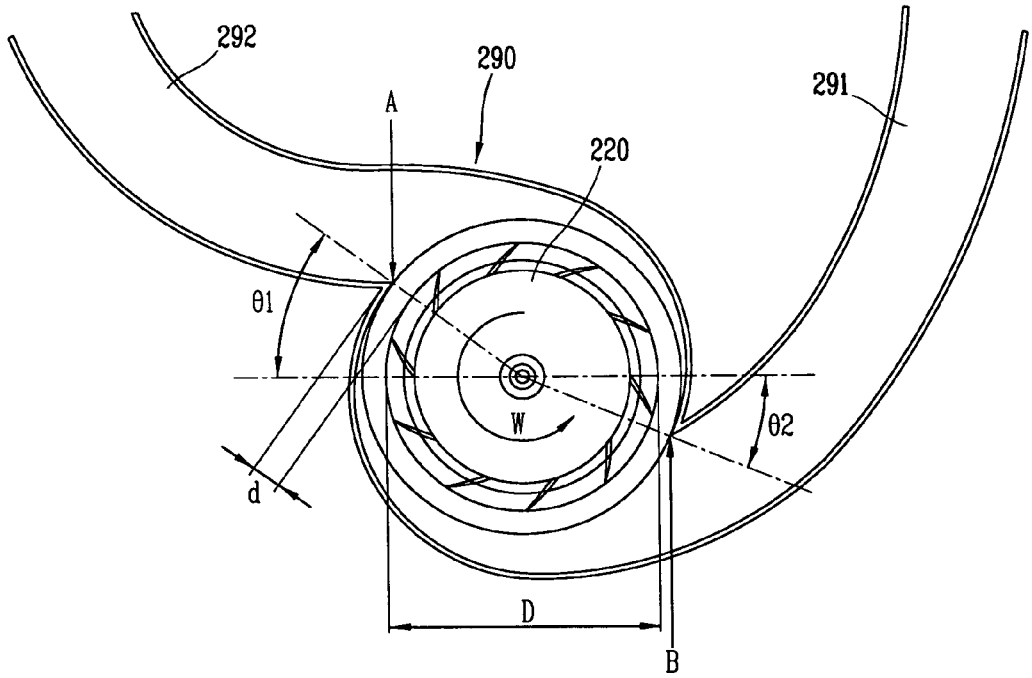
FIG. 3 is a sectional view showing an inner construction of a scroll guide of the refrigerator according to a first embodiment of the present invention.

As shown in FIG. 3, the guide pipelines 291 and 292 for guiding cool air blown by the fan 220 to the cool air ducts 270 and 280 by transmitting the cool air to the fan 220 are formed at the scroll guide 290.

The guide pipelines include a first guide pipeline 291 and a second guide pipeline 292. The first guide pipeline 291 is extending from a first starting point (A) positioned at one side of a horizontal line passing through a rotation center of the fan 220 with a certain curvature in the rotating direction of the fan 220, and is connected to the cool air duct 280 formed along a right wall surface of the freezing chamber 200. The second guide pipeline 292 is extending from a second starting point (B) positioned at another side of the horizontal line passing through the rotation center of the fan 220 with a certain curvature in the rotating direction of the fan 220, and is connected to the cool air duct 270 formed along a left wall surface of the freezing chamber 200.

The first and second guide pipelines 291 and 292 are respectively connected to each end of the cool air ducts 270 and 280 so that cool air having a lowered temperature after being heat-exchanged with the evaporator 230 can be introduced to the cool air ducts 270 and 280 respectively formed at left and right sides of the freezing chamber 200 by the fan 220.

The first guide pipeline 291 and the second guide pipeline 292 respectively have a curvature in a direction that the fan 220 is rotated so as to smoothly flow cool air blown by the fan 220, and are integrally formed with the scroll guide 290.

The first starting point (A) is positioned at 45°~55° from a horizontal line passing through a rotation center of the fan 220 in an opposite direction to the rotating direction of the fan 220, and the second starting point (B) is positioned at 15°~25° from the horizontal line passing through the rotation center of the fan 220 in an opposite direction to the rotating direction of the fan 220.

With respect to the horizontal line passing through the rotation center of the fan 220, the first starting point (A) and the second starting point (B) are is disposed at opposite sides to each other.

In FIG. 3, the reference numeral W denotes a rotating direction of the fan 220.

The reference numeral θ1 denotes an angle between the first starting point (A) and the horizontal line passing through a rotation center of the fan 220, and the reference numeral θ2 denotes an angle between the second starting point (B) and the horizontal line passing through the rotation center of the fan 220.

Figure 5:
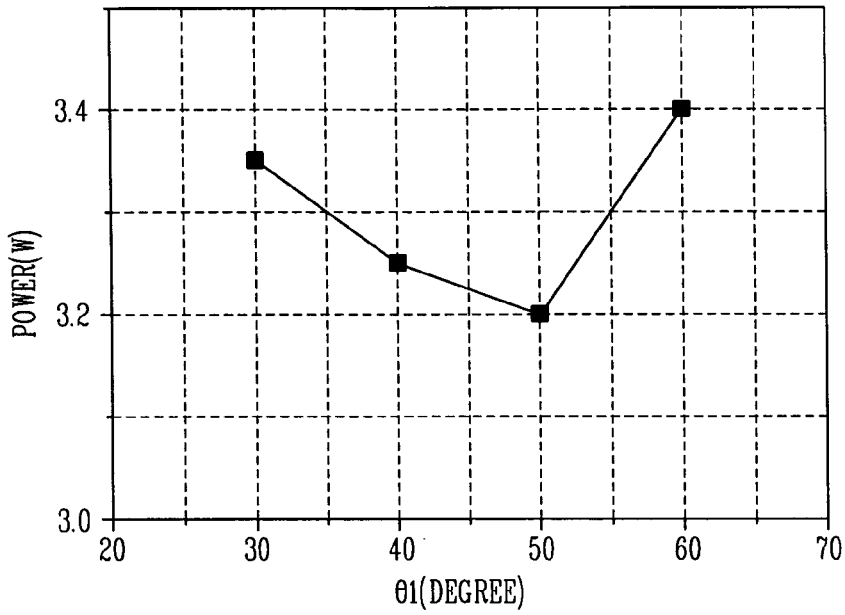
FIG. 5 is a graph showing consumption power according to θ1 of FIG. 3.
Figure 6:
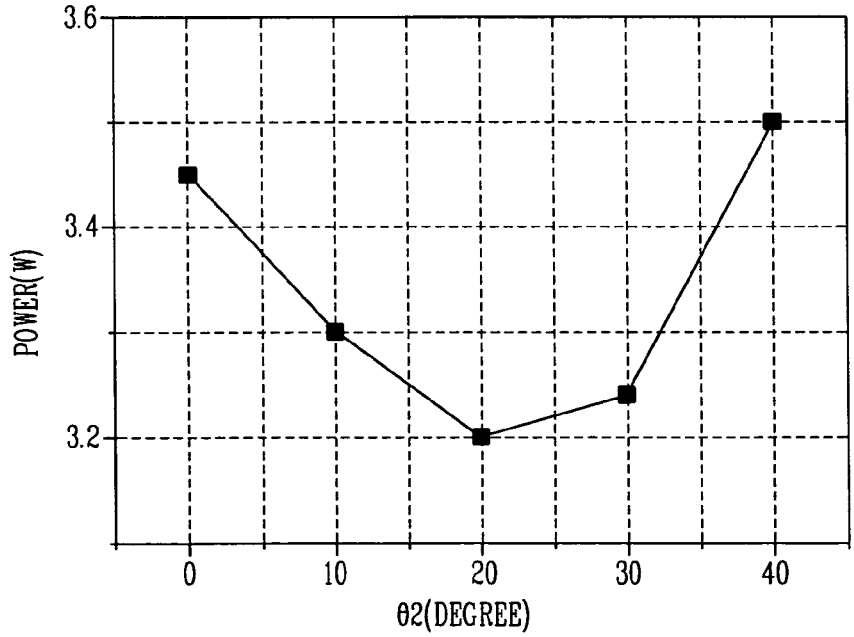
FIG. 6 is a graph showing consumption power according to θ2 of FIG. 3.

A relation between the θ1 and consumption power, and a relation between the θ2 and consumption power are shown in FIGS. 5 and 6.

Referring to FIG. 5, when the θ1 is 50°, consumption power is 3.2 W that is the lowest value. When the θ1 is more than 50°, the consumption power is increased. Accordingly, it can be known that the consumption power is relatively low when the θ1 is within the range of 45°~55°.

Referring to FIG. 6, the consumption power is relatively low when the θ2 is within the range of 15°~25°.

A flow loss of cool air is different according to each angle of the starting points A and B. When the flow loss of cool air is great, a large amount of cool air has to be supplied to the refrigerator so as to implement the same freezing or cooling capacity. Accordingly, consumption power to drive the fan is increased.

Preferably, a minimum gap between the fan 220 and the scroll guide 290 is within the range of 4%~6% of a diameter of the fan 220.

When the minimum gap between the fan 220 and the scroll guide 290 is too narrow, cool air is not smoothly circulated and consumption power is increased. On the contrary, when the minimum gap between the fan 220 and the scroll guide 290 is too wide, a suitable compression ratio can not be obtained.

Figure 4:
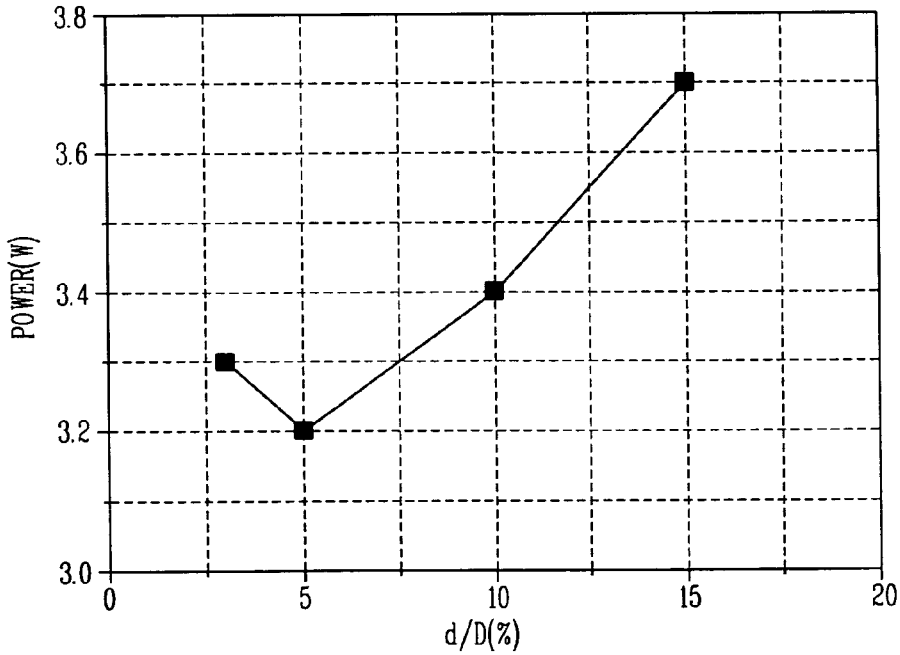
FIG. 4 is a graph showing consumption power according to a minimum gap between a fan and the scroll guide of FIG. 3.

FIG. 4 is a graph showing consumption power according to a minimum gap between the fan 220 and the scroll guide 290 of the refrigerator of FIG. 3.

When a diameter of the fan 220 is supposed to be D and a minimum gap between the fan 220 and the scroll guide 290 is supposed to be d, if the d/D is 5%, consumption power is minimized as 3.2 W. When the d/D is more than 5%, the consumption power is increased.

Accordingly, when the minimun gap (d) between the fan 220 and the scroll guide 290 is within the range of 4%~6% of the diameter (D) of the fan 220, the consumption power is relatively low.

In the aforementioned embodiment, the guide pipelines 291 and 292 of the scroll guide 290 are formed in two directions. However, one or more guide pipelines may be formed. One side of the cool air duct is connected to the guide pipeline, and another side thereof is diverged.

According to another aspect of the present invention, the refrigerator comprises: a fan 220 for blowing cool air generated by an evaporator 230 to a freezing chamber 200 or a refrigerating chamber 300; a scroll guide 290 for discharging cool air discharged from the fan 220; one or more guide pipelines 291 formed at the scroll guide 290 for guiding cool air discharged from the scroll guide 290; and a cool air duct 270 connected to the guide pipeline 291 for supplying cool air to the freezing chamber 200 or the refrigerating chamber 300.

One side of the cool air duct 270 is connected to the guide pipeline 291, and another side thereof is diverged.

Figure 1:
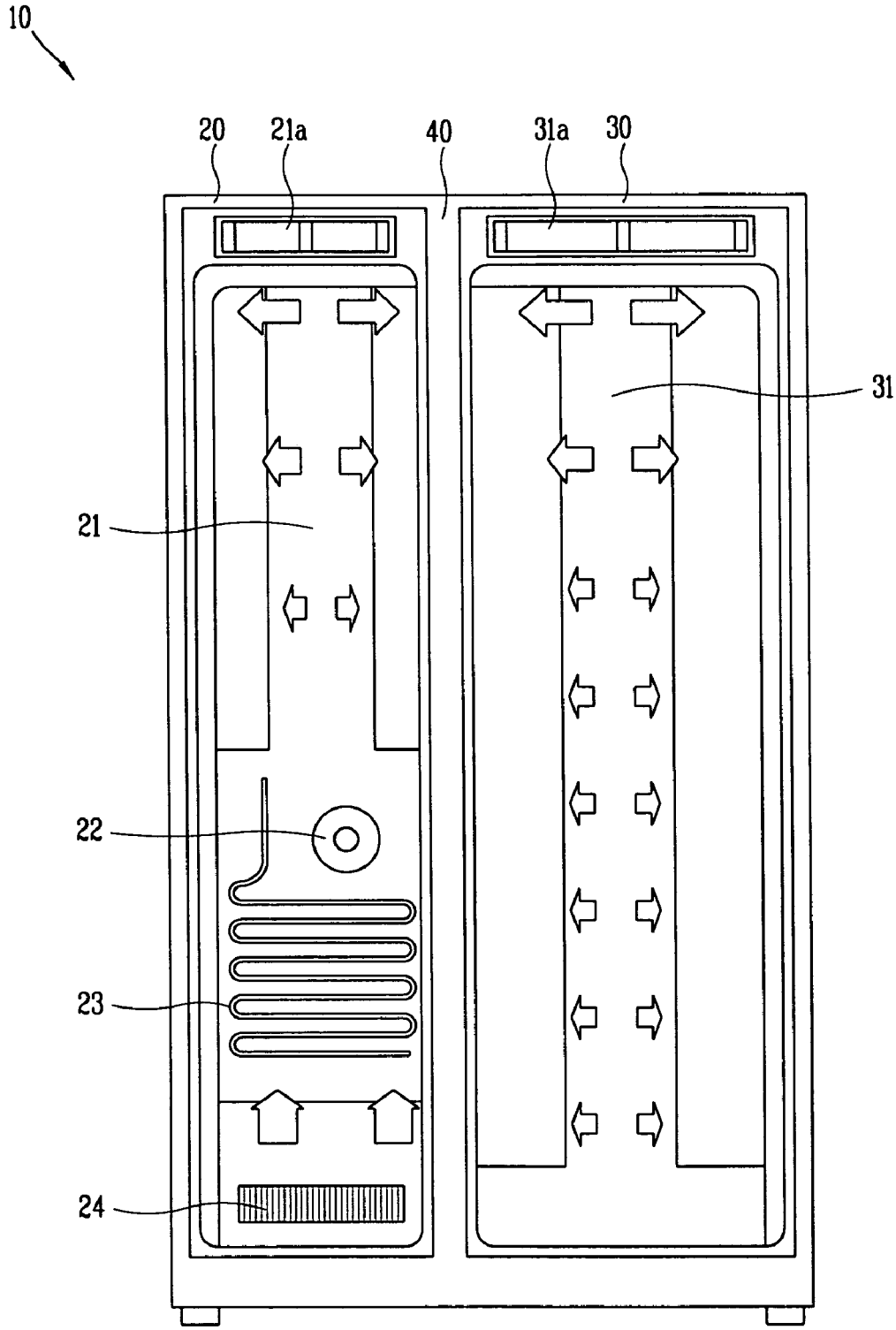
FIG. 1 CONVENTIONAL ART
FIG. 1 is a sectional view showing an inner construction of a cool air passage of a refrigerator in accordance with the conventional art.

When a user supplies power to the refrigerator, a compressor (not shown) is operated thus to cool the evaporator 230. Cool air introduced to the cool air inlet 24 of FIG. 1 formed below the evaporator 230 has a relatively increased temperature after cooling the freezing chamber 200. Then, the increased temperature cool air has a relatively lowered temperature by being heat-exchanged with the evaporator 230. The cool air is introduced into the fan 220. The fan 220 is driven by the motor 250 connected thereto. Cool air passing through the fan 220 is guided to the cool air ducts 270 and 280 through the guide pipelines 291 and 292 of the scroll guide 290 installed outside the fan 220.

More concretely, cool air having passed through the first guide pipeline 291 is introduced into the cool air duct 280 formed along a right wall surface of the freezing chamber 200. Cool air having passed through the second guide pipeline 292 is introduced into the cool air duct 270 formed along a left wall surface of the freezing chamber 200.

The cool air having been introduced into the cool air ducts 270 and 280 is evenly distributed to the freezing chamber 200 through the cool air outlets 271 and 281, thereby evenly freezing food stored in the freezing chamber 200.

So far, the refrigerator of the present invention was explained with reference to the freezing chamber 200. However, the refrigerator of the present invention can be applied to the refrigerating chamber 30 of FIG. 1.

As aforementioned, a plurality of guide pipelines are formed at the scroll guide of the fan so that the present invention can be applicable even when the cool air ducts are formed at both side walls of the freezing chamber or the refrigerating chamber. Accordingly, a flow loss of cool air discharged from the fan is minimized, and efficiency of the fan is enhanced.

Furthermore, at the time of designing the scroll guide for distributing cool air discharged from the fan to the plurality of cool air ducts formed at right and left side walls of the freezing chamber or the refrigerating chamber, main factors of the scroll guide are optimized. Accordingly, the refrigerator implements a high performance and a low consumption power.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A refrigerator, comprising:

a fan that blows cool air generated by an evaporator to a freezing chamber or a refrigerating chamber;

a scroll guide that discharges cool air discharged from the fan in two directions;

a guide pipeline device formed at the scroll guide and comprising first and second guide pipeline portions extending in two directions, respectively, that guides cool air discharged from the scroll guide; and a plurality of cool air ducts connected to the guide pipeline device, that supplies cool air to the freezing chamber or the refrigerating chamber, wherein the first guide pipeline portion extends upward from a first connecting point where the first guide pipeline portion intersects the scroll guide positioned at an angle of 45°~55° from a horizontal line passing through a rotation center of the fan in an opposite direction to a rotating direction of the fan, and wherein the second guide pipeline portion extends upward from a second connecting point where the second guide pipeline portion intersects the scroll guide positioned at an angle of 15°~25° from the horizontal line passing through the rotation center of the fan in the opposite direction to the rotating direction of the fan.

2. The refrigerator of claim 1, wherein the first guide pipeline portion extends from the first connecting point positioned at one side of the horizontal line passing through the rotation center of the fan with a certain curvature in the rotating direction of the fan, and the second guide pipeline portion extends from the second connecting point positioned at another side of the horizontal line passing through the rotation center of the fan with a certain curvature in the rotating direction of the fan.

3. The refrigerator of claim 1, wherein a minimum gap between the fan and the scroll guide is within a range of 4%~6% of a diameter of the fan.

4. The refrigerator of claim 1, wherein the first connecting point and the second connecting point are disposed at opposite sides to each other with respect to the horizontal line passing through the rotation center of the fan.

5. The refrigerator of claim 1, wherein the plurality of cool air ducts are formed along right and left walls of the freezing chamber or the refrigerating chamber.

6. The refrigerator of claim 1, wherein the number of the guide pipeline portions is equal to the number of the plurality of cool air ducts.

7. A refrigerator, comprising:

a fan that blows cool air generated by an evaporator to a freezing chamber or a refrigerating chamber;

a scroll guide that discharges cool air discharged from the fan;

a guide pipeline device formed at the scroll guide and comprising first and second guide pipeline portions, respectively, that guides cool air discharged from the scroll guide; and a plurality of cool air ducts connected to the guide pipeline device, that supplies cool air to the freezing chamber or the refrigerating chamber, wherein the first guide pipeline portion extends upward from a first connecting point where the first guide pipeline portion intersects the scroll guide positioned at an angle of 45°~55° from a horizontal line passing through a rotation center of the fan in an opposite direction to a rotating direction of the fan, and wherein the second guide pipeline portion extends upward from a second connecting point where the second guide pipeline portion intersects the scroll guide positioned at an angle of 15°~25° from the horizontal line passing through the rotation center of the fan in the opposite direction to the rotating direction of the fan.

8. The refrigerator of claim 7, wherein one side of the plurality of cool air ducts is connected to the guide pipeline device, and another side thereof comprises a plurality of cool air outlets.

9. A refrigerator, comprising:

an evaporator installed at a lower portion of a freezing chamber or a refrigerating chamber, that generates cool air;

a fan installed above the evaporator, that blows cool air generated by the evaporator to the freezing chamber or the refrigerating chamber;

a scroll guide that receives the fan therein and having first and second guide pipelines, the first and second guide pipelines each having a curvature in a rotating direction of the fan so that cool air blown by the fan is discharged in two directions, respectively and extending from opposite sides of a horizontal line passing through a rotation center of the fan; and a plurality of cool air ducts connected to the first and second guide pipelines, installed at right and left walls of the freezing chamber and the refrigerating chamber, that supply cool air to the freezing chamber and the refrigerating chamber, wherein the first guide pipeline extends upward from a first connecting point where the first guide pipeline portion intersects the scroll guide positioned at an angle of 45°~55° from a horizontal line passing through a rotation center of the fan in an opposite direction to the rotating direction of the fan, and the second guide pipeline extends upward from a second connecting point where the second guide pipeline portion intersects the scroll guide positioned at an angle of 15°~25° from the horizontal line passing through the rotation center of the fan in the opposite direction to the rotating direction of the fan.

* * * * *